United States Patent [19]

Vidakovits et al.

[11] 4,304,959

[45] Dec. 8, 1981

[54] HEAT-RECOVERABLE ARTICLE

[75] Inventors: Lajos J. Vidakovits, Le Chesnay; Didier Watine, Maisons-Lafitte, both of France

[73] Assignee: Raychem Pontoise S.A., Saint-Ouen l'Aumone, France

[21] Appl. No.: 882,641

[22] Filed: Mar. 2, 1978

[30] Foreign Application Priority Data

Mar. 4, 1977 [GB] United Kingdom ..... 9219/77

[51] Int. Cl.[3] ..... H01R 4/02

[52] U.S. Cl. ..... 174/84 R; 174/DIG. 8; 29/859; 29/872

[58] Field of Search ..... 174/84 R, DIG. 8; 29/859, 860, 868, 869, 870, 871, 872, 873

[56] References Cited

U.S. PATENT DOCUMENTS

| | | | |
|---|---|---|---|
| 3,243,211 | 3/1966 | Wetmore | 174/84 R |
| 3,312,772 | 4/1967 | Sherlock | 174/84 R X |
| 3,324,230 | 6/1967 | Sherlock | 174/84 R |

*Primary Examiner*—Roy N. Envall, Jr.
*Attorney, Agent, or Firm*—Lyon & Lyon

[57] ABSTRACT

An electrical connector comprising a heat-shrinkable sleeve, solder, a solder wettable insert and optionally a pre-installed electrical conductor, in fixed locations in the sleeve, the insert assisting in control of solder flow when the connector is heated to join the conductor to a terminal pin.

12 Claims, 2 Drawing Figures

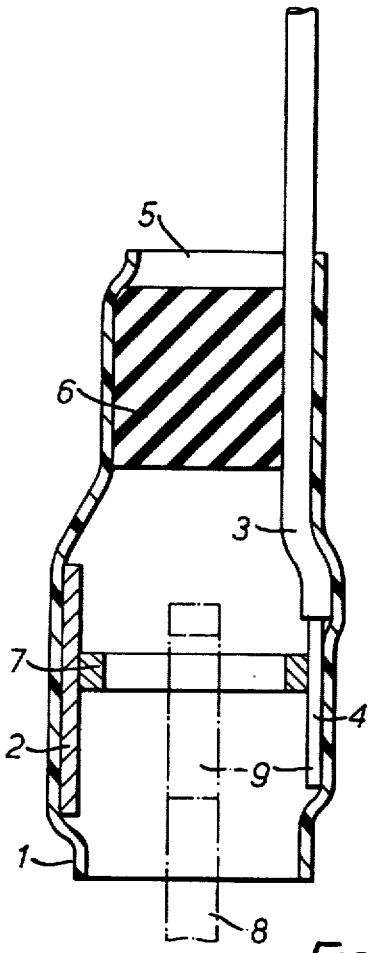
FIG. 1.
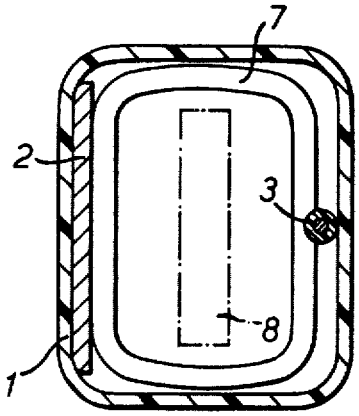
FIG. 2.
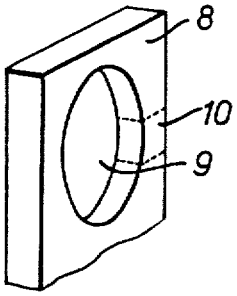

HEAT-RECOVERABLE ARTICLE

This invention relates to heat recoverable articles, more especially to heat-shrinkable sleeves having inserts therein.

It is known to make insulated soldered connexions between a pair of electrical conductors by the use of such devices, which are described in U.S. Pat. No. 3,243,211, and which comprise, for example, a heat-shrinkable sleeve of insulating material, which contains a quantity of solder placed in its central region. The sleeve may also be provided, at one or both ends, with a quantity of a fusible material, which melts when the sleeve is heated to cause recovery, and provides environmental sealing for the resulting connexion. The fusible material may also serve to prevent escape of solder from the end of the sleeve or, if there is no fusible material provided, this may be achieved by the recovery of the ends of the sleeve around the conductors, or their insulation.

Such sleeves have found many applications including, for example, the attachment of a conductor to a connector. In U.S. Pat. No. 3,324,230, for example, there is disclosed a pre-soldered pin having a heat-shrinkable sleeve preinstalled over its end by shrinking a part only of the sleeve over the pin.

Difficulties still remain in the use of such sleeves in certain applications, however. It has been found in some cases, especially when wires are being attached to very small multi pin connectors, the individual pins are too close together to allow a plurality of expanded shrinkable sleeves to be installed and partially shrunk over the pins in the way described in U.S. Pat. No. 3,324,230. Moreover, when a conductor is being attached to a terminal or tab having an aperture therein, the solder, when fused during installation, may fail to fill the aperture, and a good connexion cannot be ensured.

The present invention is therefore concerned with the provision of a heat-shrinkable sleeve containing solder, which is of use in making connexions between a conductor and a terminal.

The present invention accordingly provides a connecting means comprising a heat-shrinkable sleeve having within it a quantity of solder material, an electrical conductor, which projects from at least one end of the sleeve, the conductor advantageously being insulated except for a portion within the sleeve that is to take part in making an electrical connexion, and a solder-wettable member, infusible at the installation temperature of the connecting means, the solder material, the conductor and the member being positioned within the sleeve in a fixed relation to each other and the sleeve. The solder material, the conductor and the member are so located, and the sleeve is so shaped, that when the sleeve is positioned over an electrical conducting substrate, e.g., a terminal, to which the conductor is to be connected, the substrate may be correctly positioned relative to the various components of the connecting means and on heating to cause recovery of the sleeve and fusion of the solder material the flow of solder is controlled to make an electrical connexion between the conductor and the substrate, e.g., the terminal. The member is accordingly so located in any given embodiment that, on heating the connecting means, the flow of solder is controlled in a predetermined manner.

The sleeve may be shaped, for example may have a constriction in its central region, to assist in controlling the extent of penetration of the substrate.

The end of the sleeve from which the conductor projects may be substantially closed by, for example, a fusible member, preferably of an electrically insulating material. That end of the sleeve may be pre-recovered over the fusible member if present and the conductor; the fusible member and the recovered portion of the sleeve together may serve to fix the location of the portion of the conductor in the interior of the sleeve.

The sleeve may be so shaped, for example by selective partial pre-shrinkage, that the location of the conductor and its extent of penetration may also be controlled by the other contents of the sleeve and the interior surface of the sleeve. In this way, insertion of the conductor may, if desired, be delayed until after the sleeve is positioned on a substrate, e.g., a terminal. The invention also accordingly provides a connecting means as described and defined above with the conductor omitted.

The solder material is chosen to be suitable for the union of the conductor and the substrate; it may be, if desired or required, associated with an appropriate flux. The material is also appropriately shaped so as to allow or control passage of the substrate to its desired location and at the same time be fixed in the sleeve.

The solder is preferably in the shape of a ring. In this way, the substrate may be completely surrounded by solder. The solder may be fixed in the sleeve in any appropriate manner, for example, by partial recovery of the sleeve over the solder to make the latter a tight fit.

The shape of the solder-wettable member will depend on the configuration of the other contents of the sleeve. At its simplest, and advantageously, it is a rectangular strip, preferably with rounded corners. It may, of course, be of any other configuration but any other configuration preferably contains a portion that is of this shape. For example, the member may be of generally T-shape, with the upright of the T forming the rectangular strip and the side arms being curved to form a circle or part thereof. The rectangular strip preferably has longer and shorter sides and is preferably positioned with the longer side parallel to the axis of the sleeve. The member may advantageously be fixed in the sleeve by partial recovery of the sleeve.

The member may be formed of a solder-wettable material, or may have a solder-wettable surface. It may, if desired, be tinned. The member and the conductor may be held at least partially in their fixed relation by being soldered to each other, but the member and the conductor are preferably on opposite sides of the aperture in the substrate when the latter is within the sleeve.

In a preferred embodiment of the invention, there is provided a heat-shrinkable sleeve having two open ends and containing within it a solder ring coaxial with the sleeve, a rectangular solder-wettable strip having longer and shorter sides, the longer sides lying parallel to the axis of the sleeve and an elongate electrical conductor, an insulated portion of which projects from an open end of the sleeve and an uninsulated end of which is within the sleeve in proximity to the solder ring, the ring, the uninsulated end of the conductor and the strip being positioned in a fixed relationship to each other and to the sleeve. In use, the sleeve may be heated when installed over an electrically conductive substrate and the flow of solder may be controlled in a predetermined manner.

One form of article constructed in accordance with the invention will now be described in greater detail, by way of example only, with reference to the accompanying drawings in which FIG. 1 shows an axial section through a sleeve positioned for recovery about a pin provided with a hole, and FIG. 2 is a cross-section of the sleeve.

Referring now to the drawings, a heat-shrinkable sleeve 1 contains a solder-wettable member 2 in the form of a tinned rectangular strip the longer sides of which are parallel to the axis of the sleeve 1. An insulated conductor 3 having a bared end 4 extends from an open end 5 of the sleeve 1, a fusible insert 6 occupying most of the opening in the end 5. A ring of solder 7 is positioned in the central region of the sleeve 1. The sleeve has been partially recovered from a diameter greater than that shown, to fix the fusible insert 6, the wire 3, with its bared end 4, the member 2 and the solder ring 7 in positions so that they do not move significantly with respect to each other or to the sleeve 1.

As shown, the sleeve is positioned for recovery about a terminal pin 8 which has an aperture 9 extending transversely through its thickness. The pin may alternatively, as shown in phantom, have a C-shaped aperture indicated at 10.

On heating the assembly, the solder ring 7 and the fusible insert 6 melt, and the sleeve shrinks. When the solder melts, it wets the tinned strip 2. As a result, when the sleeve shrinks bringing terminal pin 8 and the bare end 4 of conductor 3 together, the solder is urged into the area of contact between them. Thus, the flow of solder is controlled by the tinned strip 2 so that the bared end 4 of the conductor and the pin 8 are soldered together, directly or via the strip 2. The sleeve 1 is preferably made of a transparent material, for example, polyvinylidene fluoride, so that the final product may be inspected to ascertain whether the hole 9 has been filled by solder from the ring 7, a positive indication of proper connexion.

We claim:

1. Electrical connecting means comprising a heat-recoverable sleeve open at one end to receive an electrically-conductive member, a quantity of solder disposed within the sleeve around an inner surface thereof adjacent said one end, an elongate electrical conductor secured against said inner surface by said solder and extending generally longitudinally out of said sleeve, and a solder-wettable member that is secured against said inner surface by said solder and spaced apart from said conductor circumferentially of said sleeve, said solder-wettable member, when said sleeve and said solder are heated to cause recovery of the sleeve and fusion of the solder, being adapted to direct the flow of solder to said electrically-conductive member thereby to assist in the formation of an electrical connection.

2. Electrical connecting means according to claim 1, wherein said solder-wettable member is located in said sleeve opposite said conductor.

3. Electrical connecting means according to claim 1, wherein said solder-wettable member is of substantially rectangular cross-section and extends longitudinally of said sleeve.

4. Electrical connecting means according to claim 1, comprising first and second fusible members disposed within said sleeve on longitudinally opposite sides of said solder, said fusible members being arranged to fuse and seal respective ends of said sleeve on heat recovery thereof.

5. Electrical connecting means according to claim 1, wherein said sleeve is partially heat-recovered to retain said solder, said conductor, and said solder-wettable member in position.

6. Electrical connecting means comprising a heat-recoverable sleeve open at one end to receive an electrically-conductive member, a quantity of solder disposed within the sleeve around an inner surface thereof adjacent said one end, and a solder-wettable member secured against said inner surface of the sleeve by said solder, said solder-wettable member, when said sleeve and said solder are heated to cause recovery of the sleeve and fusion of the solder, being adapted to direct the flow of solder to said electrically-conductive member thereby to assist in the formation of an electrical connection.

7. Electrical connecting means according to claim 6, comprising an elongate electrical conductor secured to said solder and extending generally longitudinally out of said sleeve, and a fusible member sealing said conductor through an end of said sleeve opposite to said one end.

8. Electrical connecting means according to claim 7, comprising a further fusible member disposed within said sleeve between said solder and said one end of the sleeve.

9. A connecting means as claimed in claim 4 wherein the fusible members are of an electrically insulating material.

10. A connecting means as claimed in claim 1, wherein the end of the sleeve from which the conductor projects has been prerecovered.

11. Electrical connecting means according to claim 6, wherein the sleeve is partially heat-recovered to retain the solder and the solder-wettable member in position.

12. Electrical connecting means comprising a heat-recoverable sleeve having two open ends and containing within it a solder ring coaxial with the sleeve, an elongate rectangular-sectioned solder-wettable strip lying parallel to the axis of the sleeve along an inner surface thereof, and an elongate electrical conductor having an insulated portion which projects from an open end of the sleeve and an uninsulated end which is within the sleeve in proximity to the solder ring, said ring, the uninsulated end of said conductor and said solder-wettable strip being positioned in a fixed relationship to each other and to the sleeve and arranged to be connected to an electrically-conductive member introducible into an open end of said sleeve, said solder-wettable strip, when said sleeve and said solder are heated to cause recovery of the sleeve and fusion of the solder, being adapted to direct the flow of solder to said electrically-conductive member thereby to assist in the formation of an electrical connection.

* * * * *